US006820606B1

(12) United States Patent
Duffey

(10) Patent No.: US 6,820,606 B1
(45) Date of Patent: Nov. 23, 2004

(54) ADJUSTABLE SEAR FOR PAINTBALL GUN

(75) Inventor: Bryan H. Duffey, 1184 Mancini St., Santa Rosa, CA (US) 95407

(73) Assignee: Bryan H. Duffey, Santa Rosa, CA (US)

( * ) Notice: Subject to any disclaimer, the term of this patent is extended or adjusted under 35 U.S.C. 154(b) by 0 days.

(21) Appl. No.: 10/376,513

(22) Filed: Feb. 28, 2003

(51) Int. Cl.[7] ..... F41A 9/16
(52) U.S. Cl. ..... 124/31; 42/69.01
(58) Field of Search ..... 42/69.01; 124/63, 124/31

(56) References Cited

U.S. PATENT DOCUMENTS 1,693,530 A * 11/1928 Spencer ..... 42/16
1,909,425 A * 5/1933 Reid ..... 42/69.01
2,659,994 A * 11/1953 Yale ..... 42/69.02
3,188,763 A * 6/1965 Duncan ..... 42/16
3,577,668 A * 5/1971 Ruger etal. ..... 42/70.06
3,580,113 A * 5/1971 Ramsay et al. ..... 42/84
3,683,537 A * 8/1972 Silva ..... 42/69.01
3,707,796 A * 1/1973 Biefeldt ..... 42/70.05
3,735,517 A * 5/1973 De Haas et al. ..... 42/23
3,755,951 A * 9/1973 Koon, Jr. ..... 42/69.02
3,757,447 A * 9/1973 Rowe ..... 42/51
3,863,375 A * 2/1975 Browning ..... 42/69.01
4,016,668 A * 4/1977 Frazier ..... 42/69.01
4,173,964 A * 11/1979 Curran ..... 124/40
4,301,609 A * 11/1981 Peterson et al. ..... 42/69.02
4,367,723 A * 1/1983 Resuggan ..... 124/67
4,447,975 A * 5/1984 Ljutic ..... 42/16
4,570,369 A * 2/1986 Gerfen ..... 42/23
4,662,098 A * 5/1987 Timari ..... 42/69.01
4,671,005 A * 6/1987 Jewell ..... 42/69.02
4,672,761 A * 6/1987 Hart ..... 42/51
4,691,461 A * 9/1987 Behlert ..... 42/69.01
4,877,008 A * 10/1989 Troubridge ..... 124/25
4,908,970 A * 3/1990 Bell ..... 42/69.02
5,115,588 A * 5/1992 Bronsart et al. ..... 42/69.02
5,613,483 A 3/1997 Lukas et al.
5,778,868 A * 7/1998 Shepherd ..... 124/76
5,857,280 A * 1/1999 Jewell ..... 42/69.03
6,553,706 B1 * 4/2003 Gancarz et al. ..... 42/69.02
2003/0154969 A1 * 8/2003 Carter ..... 124/78
2003/0168052 A1 * 9/2003 Masse ..... 124/73
2003/0178018 A1 * 9/2003 Cherry ..... 124/76

* cited by examiner

*Primary Examiner*—Jack Keith
*Assistant Examiner*—Troy Chambers
(74) *Attorney, Agent, or Firm*—Reising, Ethington, Barnes, Kisselle & Learman, P.C.

(57) ABSTRACT

The trigger assembly includes a frame attached to a launcher body, a sear pivotally mounted on the frame and having a first sear end with a hammer holding surface, and a second sear end with a trigger contact surface. A trigger is pivotally mounted on the frame and has a trigger sear arm, a sear adjustment screw received in a threaded bore in the trigger sear arm and in engagement with the trigger contact surface on the sear. A valve operating linkage is connected to an actuator control valve and to the trigger. A sear lug on the bolt engages the hammer holding surface on the first sear end to hold the hammer in the cocked position. The sear lug is adjustable relative to the hammer. The valve operating linkage is also adjustable.

6 Claims, 4 Drawing Sheets

ADJUSTABLE SEAR FOR PAINTBALL GUN

TECHNICAL FIELD

The sear adjustment adjusts the position of the contact point between the sear and a hammer relative to a sear pivot axis and adjusts the sear relative to a bolt operating actuator.

BACKGROUND OF THE INVENTION

A paintball gun employing pressurized gas to launch paintballs, to reload, and to cock a hammer, has a trigger that performs multiple tasks. These tasks include holding a hammer in a cocked position, releasing the hammer to expel a paintball and shifting an autoloader and cocker valve to load another paintball in a chamber and re-cocking the hammer. The trigger controls a sear and a valve. The trigger requires a range of movement to control the valve. Some sear movement is also required to move the sear between a hammer release position and a position in which the hammer is cocked and retained until a paintball is to be released.

The operation of the sear and the valve must be coordinated to ensure that the hammer is cocked and a paintball is in a closed chamber every time the gun is aimed and the trigger is squeezed. A purpose of the powered cocking and loading of a paintball into a chamber is to increase the rate of paintball discharges. To increase the discharge rate, the system must be ready to force a paintball into the chamber as soon as it is fed by gravity or force fed into the bolt passage.

The range of trigger movement is minimized to increase the rate of paintball discharges. The pressure required to squeeze the trigger, move the sear and release the hammer is adjustable within limits. The sears used in some paintball launchers with powered cocking of the hammer have had a tendency to float and not hold the hammer in a cocked position. When the sear does not hold the hammer in a cocked position, it is necessary to manually cock the hammer. In some situations multiple paintballs are loaded into the chamber due to the hammer floating over the sear. When there are multiple paintballs in the chamber they must be removed with care to ensure that they are not ruptured inside the barrel.

SUMMARY OF THE INVENTION

The compressed gas operated projectile launcher has a body with a bolt passage and a hammer passage. A bolt is slidably mounted in the bolt passage between a bolt open position and a blot closed position. A barrel is connected to the launcher body in axial alignment with the bolt passage. A compressed gas supply container is connected to the launcher body. A linear actuator is connected to the launcher body and to the bold for moving the bolt between the bolt open position and the bolt closed position. An actuator control valve is connected to the compressed gas supply container and to the linear actuator. The control valve is shiftable between a first valve position in which compressed gas closed the bolt and a second valve position in which compressed gas opens the bolt. A launcher valve is connected to the compressed gas supply and to the bolt passage. A hammer is slidably mounted in the hammer passage and movable between a cocked position and a launcher valve open position.

The trigger assembly includes a frame attached to the launcher body, a sear pivotally mounted on the frame and having a first sear end with a hammer holding surface, and a second sear end with a trigger contact surface. A trigger is pivotally mounted on the frame and has a trigger sear arm, a sear adjustment screw received in a threaded bore in the trigger sear arm and in engagement with the trigger contact surface on the sear. At least one valve operating link is connected to the actuator control valve and to the trigger. A sear lug on the bolt engages the hammer holding surface on the first sear end to hold the hammer in the cocked position. The trigger is pivoted in one direction to move the hammer holding surface on the sear away from the sear lug thereby releasing the hammer.

BRIEF DESCRIPTION OF THE DRAWINGS

The presently preferred embodiment of the invention is disclosed in the following description and in the accompanying drawings, wherein.

DETAILED DESCRIPTION OP THE PREFERRED EMBODIMENT

Figure 6:
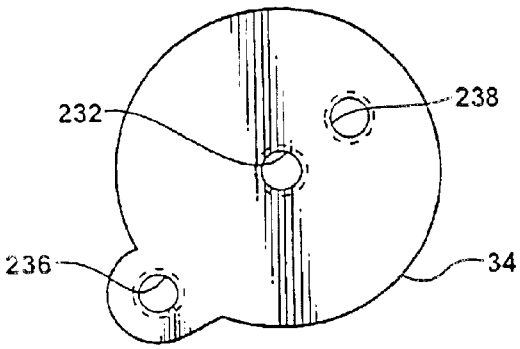
FIG. 6 is a front elevational view of the cap with the low pressure regulator, the gas operated linear actuator, and the spool valve removed.

The paint ball launcher 10 includes a body 12, with a bolt passage 14 and a hammer passage 16. A barrel 18 is attached to the front of the body 12 and is coaxial with the bolt passage 14. A bolt assembly 20 is slidably mounted in the bolt passage 14. A high pressure gas chamber bore 22 is provided in a forward portion of the body 12 below the bolt passage 14. A gas valve 24 is mounted in an open rear end of the gas chamber bore 22. A primary pressure regulator 26 is attached to the body 12 and connected to the gas chamber bore 22 by a gas passage 30. A gas supply cylinder 28 is connected to an inlet of the pressure regulator 26. A low pressure regulator 32 is secured to an end cap 34 fixed to the forward end of the body 12. A spool valve 36 is also connected to the end cap 34. A gas operated linear actuator 38 is also connected to the end cap 34. The spool valve 36 is offset to the right side of a vertical plane through the axis 40 of the barrel 18 and the linear actuator 38 is offset to the left side of the vertical plane through the axis of the barrel. Both the linear actuator 38 and the spool valve 24 have been moved into vertical alignment with the axis of the barrel in drawing FIGS. 1–3 for clarity. The low pressure regulator 32 screws into a threaded bore 232, in the end cap 34 shown in FIG. 6. The threaded bore 232 is coaxial with the gas chamber bore 22. The spool valve 36 screws into a threaded bore 236 in the end cap 34. The linear actuator 38 screws into a threaded bore 238 in the end cap 34. A marker frame or trigger housing assembly 42 is secured to the body 12 by cap screws 44 and 46. The bolt assembly 20 includes a bolt 48 that is slidably mounted in the bolt passage 14. An end block 50 is secured to the bolt 48 by a pin 52.

The linear actuator 38 includes a cylindrical bore 54. A piston 56 is slidably mounted in the bore 54. A ram 58 has a forward end connected to the piston 56, extends through a passage 60 through the body 12, and has a rear end connected to the end block 50.

Figure 1:
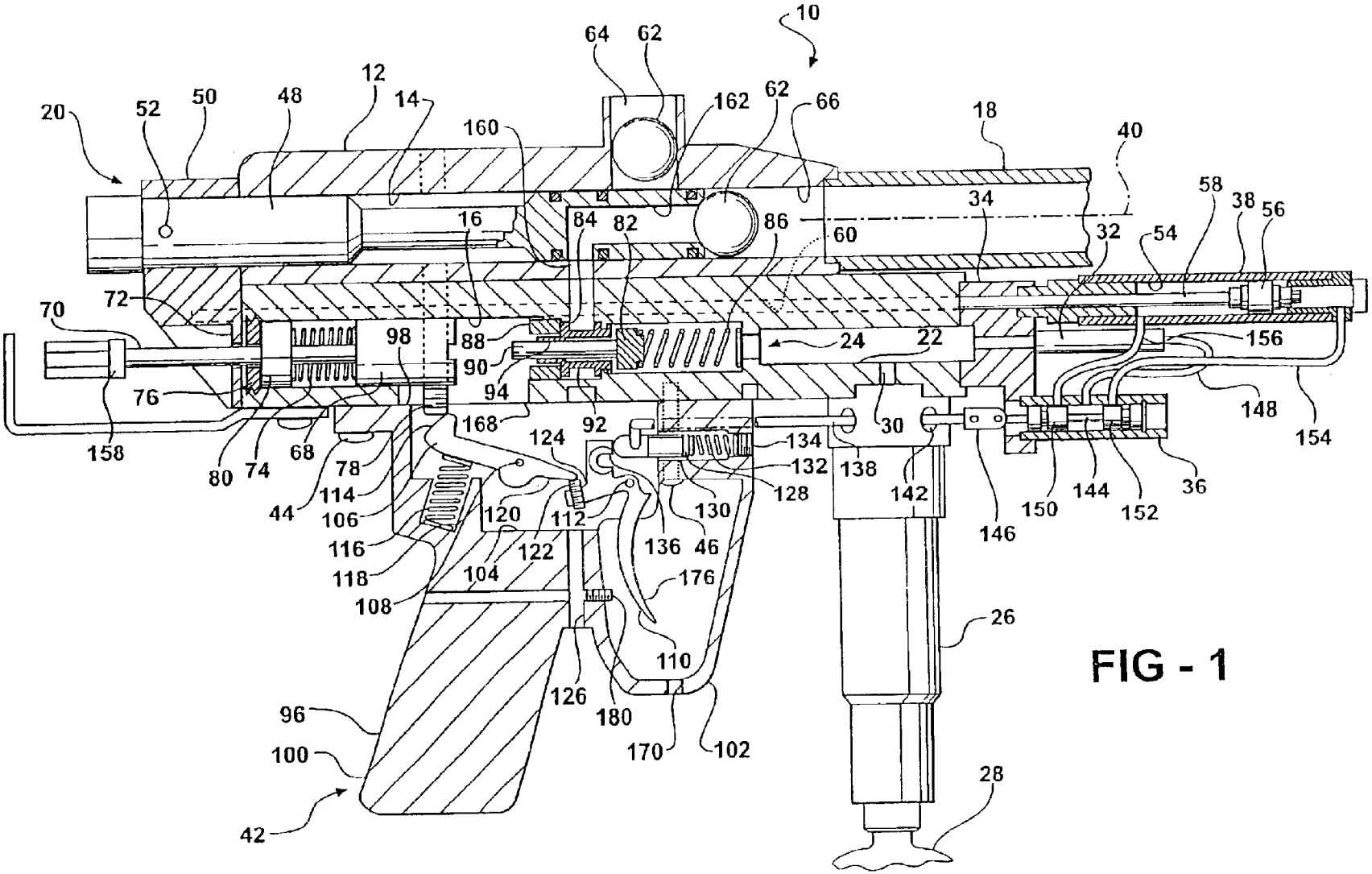
FIG. 1 is a vertical sectional view with a spool valve and the gas operated linear actuator both moved into and centered in the plane in which the section is taken, with the bolt closed, with a paintball positioned for launching, and with parts broken away.

A paintball magazine (not shown) is connected to the body 12 and supplies paintballs 62 to the ball feed passage 64. When the piston 56 moves the bolt 48 to the rear and to the position shown in FIG. 3, a paintball 62 moves into the chamber 66. Paintballs 62 can be fed by gravity into the passage 64 and into the chamber 66 or they can be force fed. When the piston 56 moves the bolt 48 forward, the chamber 66 is closed and the paintball 62 is moved forward in the chamber to the position shown in FIG. 1. The paintball launcher 10 as shown in FIG. 1 is ready to launch the paintball 62 that is in the closed chamber 66.

A hammer 68 is slidably mounted in the hammer passage 16. The hammer 68 includes a cocking rod 70 that extends rearward and through a bore 72 through the end block 50. A compression hammer spring 74 acts on the hammer 68 and on a hammer retainer block 76 anchored in the rear portion of the hammer passage 16. The spring 74 urges the hammer forward and away from the end block 50. A sear lug 78 is attached to the hammer 68. The sear lug 78 is preferably vertically adjustable. The adjustment can be made by screwing the sear lug 78 up into the hammer 68 or down out of the hammer. Access to the sear lug 78 for adjustment can be obtained by removing cap screws 44 and 46 to remove the trigger housing 42 or by inserting an Allen wrench down through bores (not shown) through the body 12, the bolt 48 and into the hammer 68. A velocity adjustment spacer 80 is placed between the retainer block 76 and the compression spring 74 to adjust the spring force exerted on the hammer 68. Adjustment can be made by replacing the spacer 80 with another spacer having a different axial thickness. The spring force could be changed by changing the spring 74.

The gas valve 24 includes a valve head 82 that is urged toward a valve seat 84 by a valve spring 86. The valve seat 84 is clamped in a fixed position by a threaded valve seat retainer 88. A valve rod 90 is integral with the valve head 82, extends through a large diameter bore 92 in the front of the valve seat 84, and through a small diameter sealing bore 94 in the rear portion of the valve seat 84.

The trigger housing assembly 42 includes a frame 96 with a mounting surface 98, a hand grip 100, a trigger guard 102 and a sear and trigger chamber 104. A sear 106 is pivotally mounted in the sear and trigger chamber 104 by a sear pivot pin 108 that is pressed into sear pivot pin apertures through the side walls of the sear and trigger chamber 104 and pivotally supports the sear 106. A trigger 110 is pivotally mounted in the sear and trigger chamber 104 by a trigger pivot pin 112 that is pressed into trigger pivot pin apertures through the side walls of the chamber 104 and pivotally supports the trigger 110. The trigger pivot pin 112 is parallel to the sear pivot pin 108 in a position forward and below the sear pivot pin.

The sear 106 has an arcuate hammer holding surface 114 that contacts the sear lug 78 on the hammer 68 to hold the hammer in a cocked position as shown in FIG. 1. The sear spring 116 is received in a spring bore 118 and urges the sear 106 toward and into the path of movement of the sear lug 78 on the hammer 68. The opposite end of the sear 106 from the hammer holding surface 114 has a trigger contact surface 120 that sits on a sear height adjustment screw 122. The adjustment screw 122 screws into a threaded bore in a trigger sear arm 124 on the trigger 110. The adjustment screw 122 is raised by inserting an Allen wrench through the sear adjustment passage 126 in the trigger house 42, and into engagement with the adjustment screw 122 and rotating the screw 122 clockwise. The sear height adjustment screw 122 is lowered by turning the adjustment screw counterclockwise. Raising the adjustment screw 122 lowers the upper end of the hammer holding surface 114 and moves the contact point between the sear lug and the hammer 68 vertically downward toward the sear pivot pin 108. Lowering the sear height adjustment screw 122 raises the upper end of the hammer holding surface 114. The sear lug 78 may also have to be adjusted.

Rotating the trigger 110 clockwise about the trigger pivot pin 112 moves the hammer holding surface 114 downward and releases the hammer 68 to be moved forward by the compression spring 74 and open the gas valve 24.

A cylindrical slider or piston 128 is slidably mounted in a horizontal bore 130 in the upward forward portion of the trigger housing 42. A piston spring 132 engages the forward end of the piston 128 and a plug 134 engages the forward end of the piston 128 and a plug 134 that screws into the forward end of the horizontal bore 130. The spring 132 urges the piston 128 rearward, into engagement with an operating arm 136 on the trigger 110, and urges the trigger to rotate counterclockwise, as viewed in FIG. 1, about the trigger pivot pin 112. A spool valve operating link 138 is pivotally attached to the piston 128 and extends through a passage 142 through the primary pressure regulator 26. A forward end of the operating link 138 is connected directly to the spool 144 by a turn buckle 146. The turn buckle adjusts the timing of opening and closing of ports in the spool valve 36 relative to the position of the sear 106.

Figure 2:
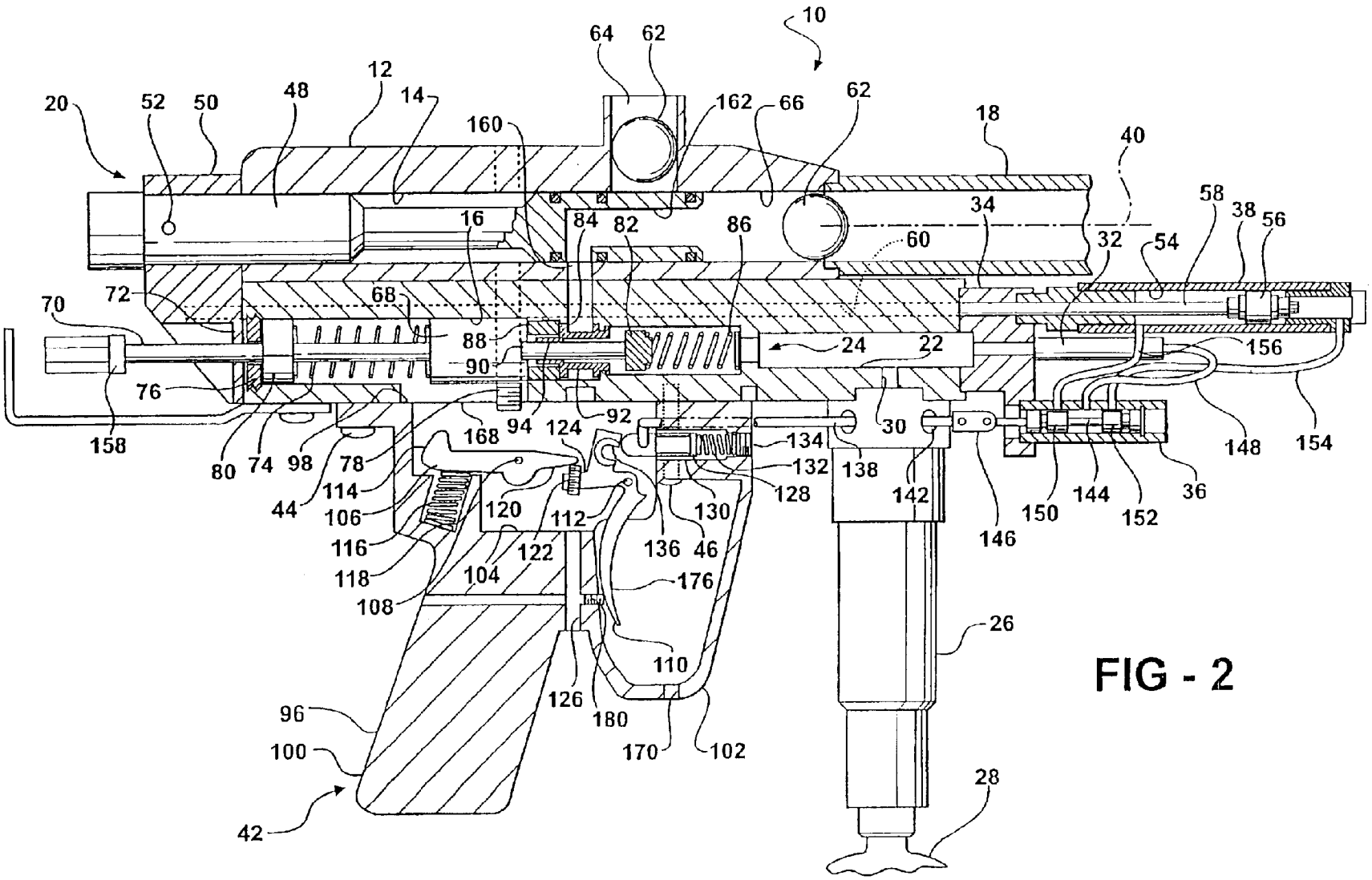
FIG. 2 is a sectional view similar to FIG. 1 with the hammer released, the gas valve open and a paintball moving out of the chamber and through the barrel.
Figure 3:
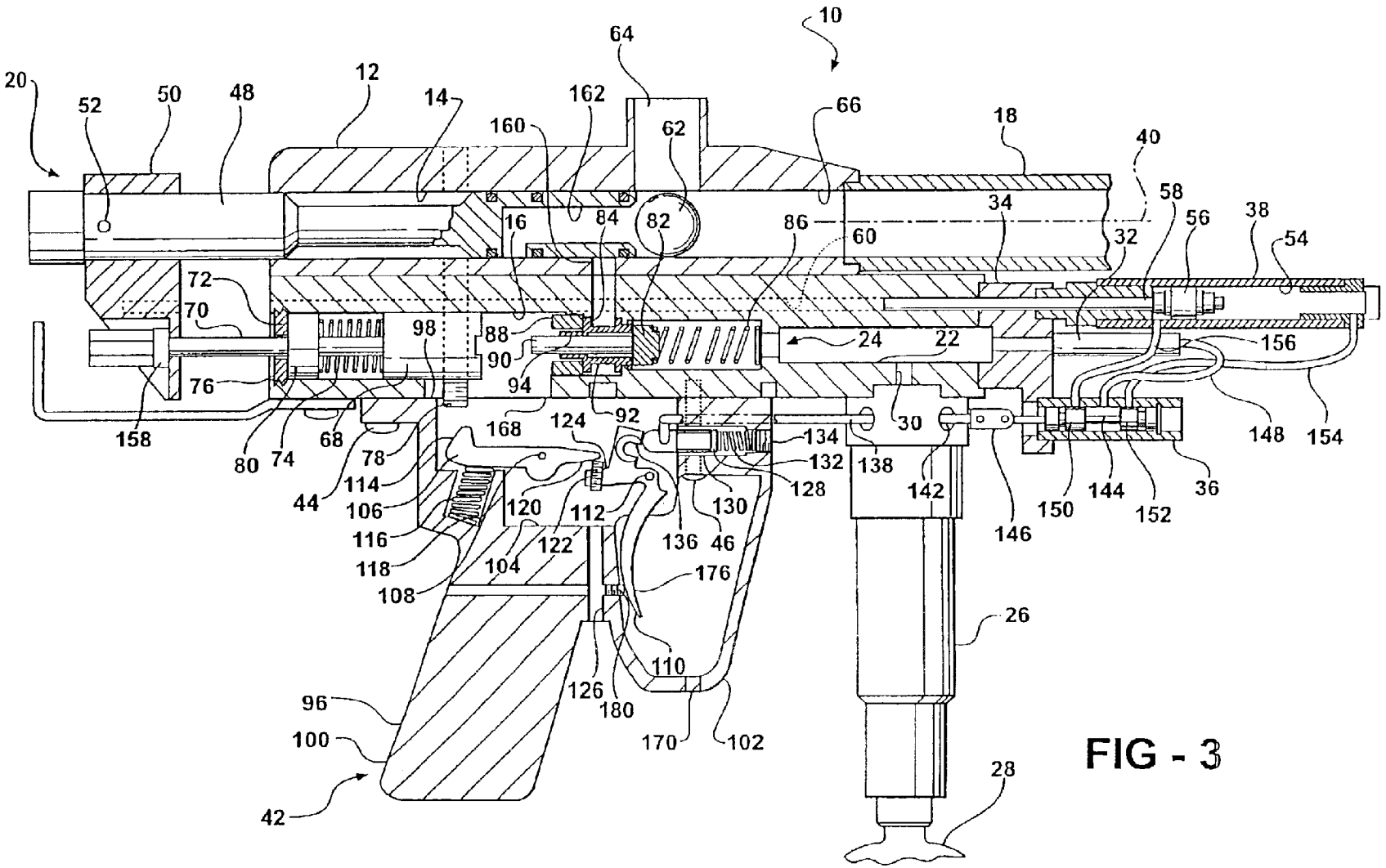
FIG. 3 is a sectional view similar to FIG. 1 with the bolt open and the trigger depressed.

The spool valve 36 is connected to a supply of low pressure gas from the low pressure regulator 32 by a supply tube 148. Lands 150 and 152 on the spool 144 block the flow of gas under pressure to tubes 154 and 156 when the spool 144 is in a centered neutral position. Moving the spool 144 to the rear results in the land 150 opening the passage to the tube 156, moves the piston 56 forward, and closes the bolt 48. As the bolt 48 moves to a closed position, a lug 78 on the hammer 68 contacts the hammer holding surface 114 on the sear 106 and holds the hammer 68 in a cocked position. Moving the spool 144 forward results in the land 152 moving forward of and opening the passage to the tube 154. Gas under pressure is supplied to the head end of the cylindrical bore 54 by the tube 154 and the piston 56 is moved rearward. As the piston 56 moves rearward, the bolt 48 moves toward an open position. The spool 144 is in a rear position and the land 150 is rearward of the opening to tube 156 when the finger engaging arm 176 of the trigger 110 is in a forward position. With the spool 144 in a rearmost position, tube 156 communicates with tube 148, the piston 56 moves forward and the bolt 48 is closed as shown in FIG. 1. Squeezing the trigger 110 moves the spool land 150 into a position in which the port to tube 156 is closed and gas in the rod end of the linear actuator holds the bolt 68 in a closed position. Further movement of the trigger 110 in a clockwise direction, as shown in FIGS. 1, 2 and 3, moves the sear 106 counterclockwise and releases the hammer 68 to move forward and strike the valve rod 90 as shown in FIG. 2. The hammer 68 strikes the valve rod 90 with sufficient force to lift the valve head 82 from the valve seat 84 and compresses the valve spring 86. When the valve head 82 is off the valve seat 84, gas under pressure in the high pressure gas chamber bore 22 flows into the large diameter bore 92, through the passage 160 in the body 12 and through the bolt gas passage 162. Gas passing through the bolt passage 162 propels a paintball 62 out of the chamber 66 and through the barrel 18. The valve spring 86 overcomes the hammer compression spring 74 and forces the valve head 82 into engagement with the valve seat 84 and thereby cuts off the flow of gas from the gas chamber 22. Releasing the trigger 110 allows the piston spring 132 to move the piston 128 to the rear, rotates the sear 106 clockwise about the sear pivot pin 108, moves the spool 144 rearward and supplies gas under pressure through the tube 156 to move the piston 56 forward. Movement of the piston 56 and the piston ram 58 to the front closes the bolt 48 and leaves the hammer 68 cocked.

The bolt passage 14 and the hammer passage 16 are shown in the drawing as being bores in two different body members. The bolt passage 14 and the hammer passage 16 can also be bores in one unitary body member 12. The gas valve 24 can take a number of different forms.

The trigger housing 42 has a top mounting surface 98 that mates with a bottom surface 168 on the body 12. Cap screws 44 and 46 clamp the trigger housing 42 to the bottom surface 168. A passage 170 is provided in the trigger guard 102 for an Allen wrench to tighten the cap screw 46.

Figure 4:
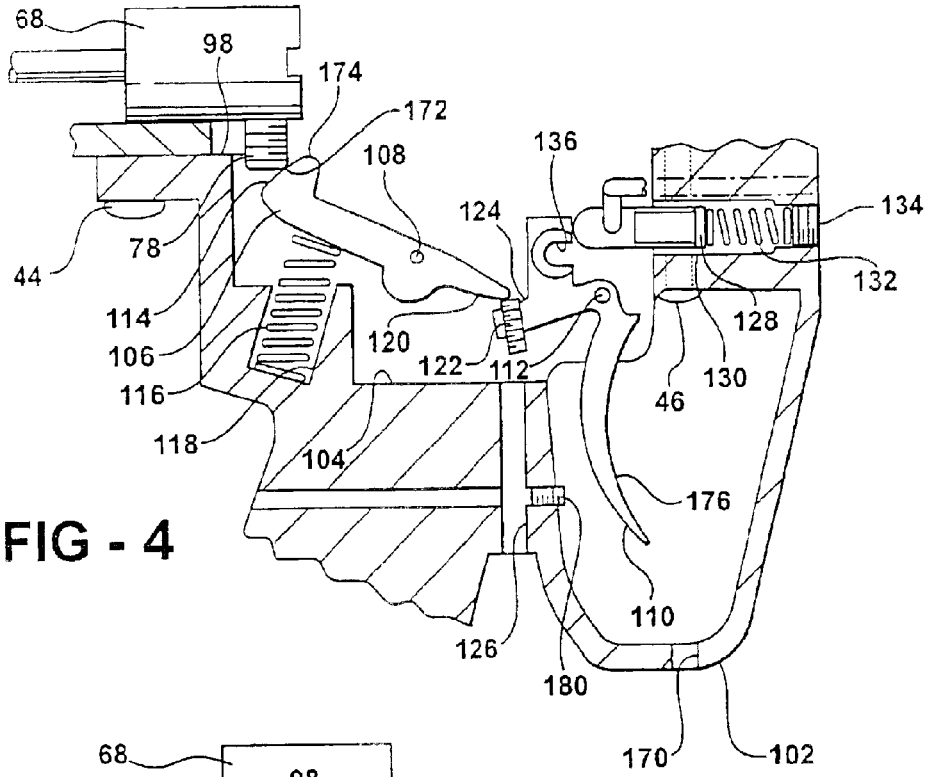
FIG. 4 is an enlarged sectional view of the trigger housing and the hammer with the contact point between the sear and the hammer too far from the sear tip.
Figure 5:
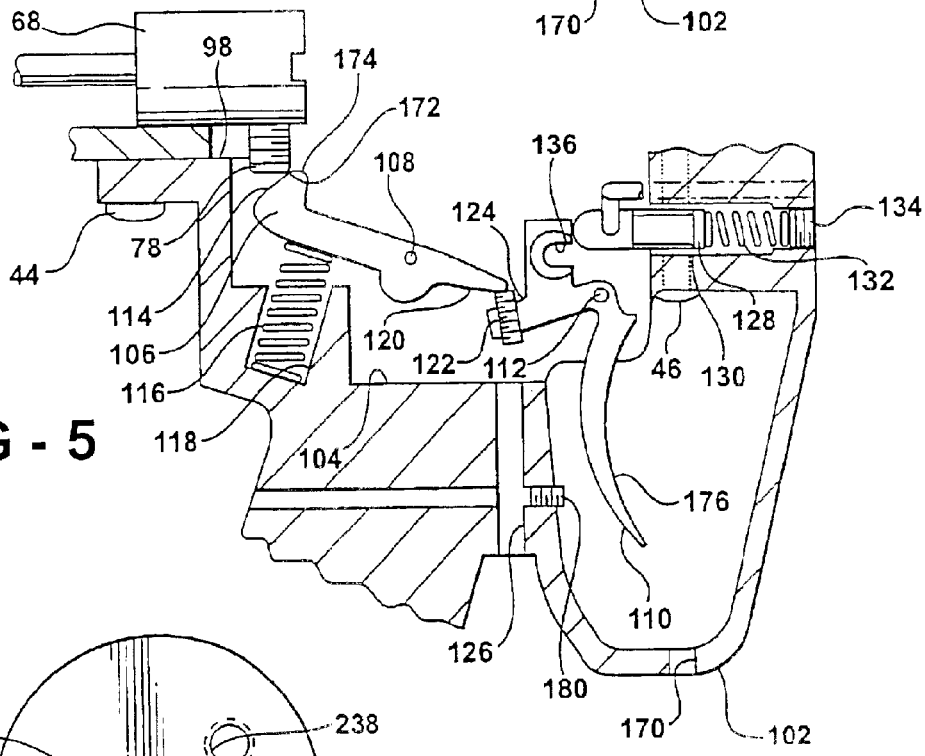
FIG. 5 is a view similar to FIG. 4 with a contact point between the sear and the hammer close to the sear tip.

The trigger 110 controls the sear 104 and the spool 144 of the spool valve 36. The timing of the sear 106 relative to the spool 144 is critical. The operation of the sear 106 relative to the hammer 68 is also critical. If the contact point 172 between the sear 106 and the hammer 68 is too far above the sear pivot pin 108, the sear lug 78 will rotate the hammer holding surface 114 downward, slide over the sear tip 174 and fail to hold the hammer 68 in a cocked position. If the contact point 172 is too low relative to the sear pivot pin 108, the pressure on the trigger 110 required to release the hammer 68 may be larger than desirable. If the contact point 172 is spaced too far below the sear tip 174 as shown in FIG. 4, the trigger 110 will have to pivot a substantial distance to release the hammer 68. A relatively small movement of the trigger 110 to release the hammer is considered desirable.

The sear lug 78 can be adjustable relative to the hammer 68 or it can be fixed relative to the hammer. If the sear lug 78 is fixed relative to the hammer 68, the sear height adjustment screw 122 is the only adjustment of the range of movement of the trigger 110 required to release the hammer 68. If the sear lug 78 is vertically adjustable relative to the hammer 68, the sear lug can be adjusted to adjust travel of the trigger 110 required to release the hammer 68 and the sear height adjustment screw 122 can be adjusted to ensure that the sear holds the hammer in a cocked position, to adjust trigger pull force, and to coordinate the release of the hammer 68 with the opening of the bolt 48. Timing of the opening of the bolt 48 relative to the opening of the gas valve 44 can also be obtained by changing the length of the spool valve operating link 138 with a turn buckle 146. However, more precise adjustments can be made by the sear height adjustment screw 122.

During operation of the paintball launcher 10, the operator attaches a paintball magazine to the ball feed passage 64 and a paintball 62 enters the ball feed passage from the magazine. A gas supply cylinder 28 is attached to the primary pressure regulator 26. The regulator 26 supplies gas at a pressure of about 600 pounds per square inch to the high pressure gas chamber bore 22. The low pressure regulator 32 receives gas from the chamber 22 and supplies gas at about 90 pounds per square inch to the spool valve 36 through supply tube 148. The spool 144, which is moved rearward by the piston spring 132, supplies gas through the tube 156 to the rod end of the cylinder bore 54 in the gas operated linear actuator 38. Gas in the rod end of the linear actuator 38 forces the piston 56 forward, closes the bolt 48, and moves the paintball forward in the chamber 66. If the hammer is not cocked, the cocking rod end member 158 is manually pulled to the rear to a cocked position. At this stage the bolt 48 and the hammer 68 are in the position shown in FIG. 1. The head end of the linear actuator 38 is connected to atmosphere. The paintball launcher 10 is now ready to launch a paintball.

The operator squeezes the trigger 110 moving the finger engaging arm 176 toward the hand grip 100 and rotating the trigger about the trigger pivot pin 112. Manual rotation of the trigger 110 moves the piston 128 toward the piston spring 132 and the plug 134 thereby moving the spool valve operating link 138 forward and shifting the spool 144 forward. Forward movement of the spool 144 closes tubes 154 and 156 thereby keeping the rod end of the linear actuator 38 pressurized and holding the bolt 48 in a closed position. The spool 144 is shown in FIG. 1 in its position at the time the sear 106 releases the hammer 68. Movement of the finger engaging arm 176 to the rear simultaneousy moves the spool 144 forward and the hammer holding surface 114 on the sear 106 downward. The sear 106 releases the hammer 68 just after the land 150 on the spool 144 closes the tube 156. The hammer 68 is forced forward by the compression spring 174, strikes the valve rod 90, compresses the valve spring 86 and separates the valve head 82 from the valve seat 84. Gas in the high pressure gas chamber 22 passes into the large diameter bore 92 in the valve seat 84, through the passage 160 in the body 12, into the bolt gas passager 162, and forces a paintball 62 out of the chamber 66 and through the barrel 18. The valve spring 86 forces the valve head 82 to a closed position in sealing engagement with the valve seat 84 after sufficient gas has passed through the gas valve 24 to accelerate the paintball 62 to the desired speed. Moving the valve head 82 to the closed position moves the hammer 68 to the rear a short distance and compresses the compression spring 74 somewhat.

Continued movement of the finger engaging arm 176 of the trigger 110 moves the spool 144 forward from the position shown in FIG. 1, opens tube 156 to atmosphere, and moves land 152 forward to open a passage between the supply tube 148 and the tube 154. The tube 154 supplies gas under pressure from the low pressure regulator 32 to the head end of the linear actuator 38 and forces the piston 56 rearward. Rearward movement of the piston 56 opens the bolt 48, moves the end block So rearward and moves the hammer 68 rearward. When the bolt 48 is fully opened, as shown in FIG. 3, another paintball 62 moves down out of the ball feed passage 64 and into the chamber 66. After a paintball 62 is launched from the barrel 18, pressure on the finger engaging arm 176 of the trigger 110 is released and the piston spring 132 moves the piston 128 rearward, rotates the trigger about the trigger pivot pin 112, and moves the spool 144 of the spool valve 36 rearward. The land 150 moves to a position in which the supply tube 148 supplies gas to the tube 156, the land 152 is to the rear of the tube 156 and the head end chamber of the linear actuator 38 is connected to atmosphere. The tube 156 supplies gas to the rod end of the linear actuator 38 and moves the piston 56 forward. Forward movement of the piston 56 closes the bolt 48 and moves a paintball 62 forward into the chamber 66 and into a position to be launched. The trigger 110 is in position to be squeezed toward the hand grip 100 and start the cycle over again.

The maximum movement of the free lower end of the finger engaging arm 176 of the trigger 110 is about 0.25 inches. A stop 180 is generally provided to reduce the range of movement of the trigger to well less than 0.25 inches. To perform all the functions required with a total movement of the trigger 110 less than 0.25 inches, timing between the sear 106 and the spool 144 of the spool valve 36 must be properly set and adjusted and the system components must be accurate and precise.

The disclosed embodiment is representative of a presently preferred form of the invention, but is intended to be illustrative rather than definitive thereof. The invention is defined in the claims.

I claim:

1. An adjustable sear for a compressed gas operated projectile launcher comprising:

a trigger housing with a launcher body mounting surface and a sear and trigger chamber within the trigger housing;

a sear pivotally supported in the sear and trigger chamber, by a sear pivot pin mounted in a sear pivot pin aperture through the trigger housing, and having a hammer holding surface on a first sear end and a trigger contact surface on a second sear end;

a trigger pivotally supported in the sear and trigger chamber by a trigger pivot pin mounted in a trigger pivot pin aperture through the trigger housing, that is parallel to the sear pivot pin and wherein the trigger includes a trigger sear arm engagable with the trigger contact surface on the sear, and an operating arm with an operating valve control surface;

at least one stop, on the trigger housing, that limits pivotal movement of the trigger in one direction;

a sear adjuster on the trigger sear arm that pivots the sear relative to the trigger and changes the position of the hammer holding surface relative to the trigger when the trigger is positioned by the at least one stop;

a launcher body secured to the launcher body mounting surface on the trigger housing, a hammer passage in the launcher body, a hammer slidably mounted in the hammer passage, and a sear lug on the hammer that engages the hammer holding surface on the sear to hold the hammer in a cocked position; and wherein the sear lug is adjustable relative to the hammer.

2. An adjustable sear for a compressed gas operated projectile launcher, as set forth in claim 1, wherein the sear adjuster includes a sear adjustment screw that is received in a threaded bore in the trigger sear arm and a screw end on the sear adjustment screw engages the trigger contact surface on the second sear end.

3. An adjustable sear for a compressed gas operated projectile launcher, as set forth in claim 1, including a piston slidably mounted in a piston bore in the trigger housing, a spring in the piston bore that urges the piston toward the operating valve control surface on the operating arm, and a control valve attached to the launcher body and connected to the piston.

4. An adjustable sear for a compressed gas operated projectile launcher, as set forth in claim 3, including a spool valve operating link connected to the piston and to a spool of the control valve.

5. An adjustable sear for a compressed gas operated projectile launcher, as set forth in claim 1, wherein pivotal movement of the trigger pivots the sear and releases the hammer from the cocked position.

6. An adjustable sear for a compressed gas operated projectile launcher, as set forth in claim 1, wherein the sear lug is adjusted relative to the hammer to adjust the distance a finger engaging arm of the trigger is moved to release the hammer.

* * * * *